United States Patent [19]

Sprow

[11] Patent Number: 4,574,046

[45] Date of Patent: Mar. 4, 1986

[54] CENTRIFUGAL JIG FOR ORE BENEFICIATION

[76] Inventor: Earnest A. Sprow, E. 8620 - 44th Ave., Spokane, Wash. 99206

[21] Appl. No.: 653,029

[22] Filed: Sep. 21, 1984

[51] Int. Cl.[4] ..... B03B 5/20

[52] U.S. Cl. ..... 209/44; 209/423; 209/466; 209/486; 209/500; 209/502; 209/498

[58] Field of Search ..... 209/303, 44, 453, 425, 209/426, 468, 469, 279, 280, 270, 255, 243, 250, 17, 240, 380, 273, 423, 424, 466, 467, 304, 305, 306, 293, 295, 451, 486, 502; 210/360.2, 393

[56] References Cited

U.S. PATENT DOCUMENTS

| | | | |
|---|---|---|---|
| 2,850,165 | 9/1958 | Hesse et al. . | |
| 3,062,375 | 11/1962 | Palm . | |
| 3,100,746 | 8/1963 | Holowaty . | |
| 3,167,503 | 1/1965 | Pitchford . | |
| 3,767,047 | 10/1973 | Rasmussen . | |
| 3,804,247 | 4/1974 | Miscovich . | |
| 4,056,464 | 11/1977 | Cross | 209/44 X |
| 4,155,841 | 5/1979 | Chupka et al. | 209/273 |
| 4,267,035 | 5/1981 | Martin | 209/306 X |
| 4,279,741 | 7/1981 | Campbell | 209/44 |
| 4,391,702 | 7/1983 | Murakami et al. | 209/270 X |

*Primary Examiner*—Frank W. Lutter
*Assistant Examiner*—Thomas M. Lithgow
*Attorney, Agent, or Firm*—Keith S. Bergman

[57] ABSTRACT

A centrifugal jig to beneficiate ore by separating a heavier particulate fraction from a lighter particulate pulp. The jig provides a rotor with a vertical cylindrical jig screen rotating in a fluid filled hutch to support a vertical jigging bed. The jigging bed is pulsed sequentially as it is rotated past plural spaced pulsing elements positioned in the hutch externally of the jigging screen. Pulsing may be by pressurized air in the form of fine bubbles, by pressurized fluid or a combination of both. Pulp material is fed at the bottom of the jigging screen to move upwardly thereacross with the lighter gangue material exiting above the screen for exhaustion and the heavier mineral bearing fraction exiting through the screen for subsequent recovery from the bottom periphery of the hutch area. The jig may be used as a bedded centrifuge or in the fashion of a traditional jig especially as when provided with ragging. A particular impeller type seal is provided to lessen fluid exit between the adjacent relatively movable surfaces of rotor and hutch.

10 Claims, 9 Drawing Figures

FIG. 2
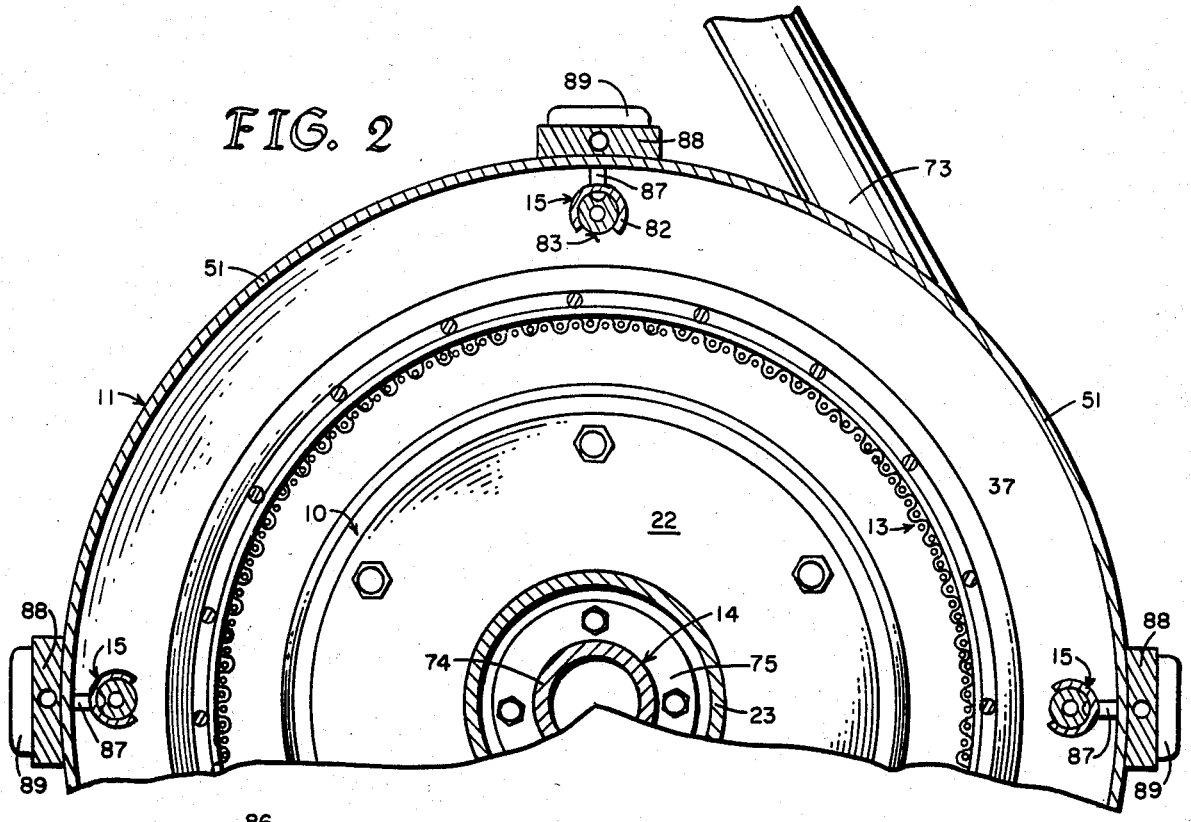
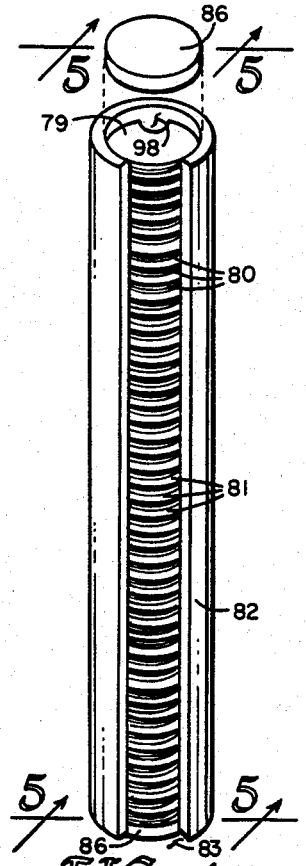
FIG. 4
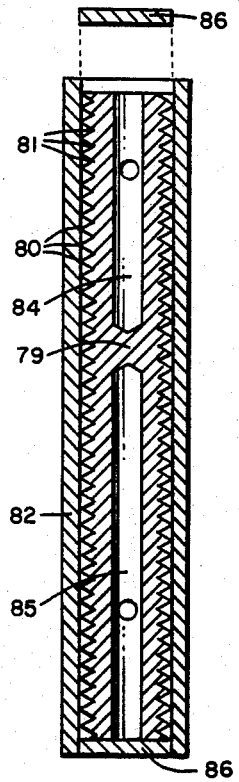
FIG. 5
FIG. 6
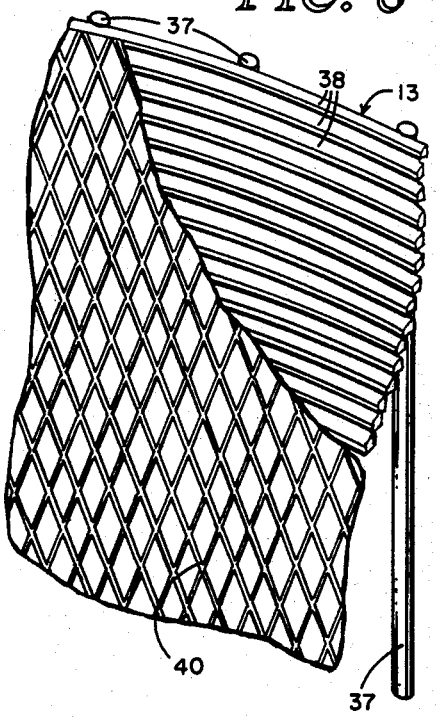

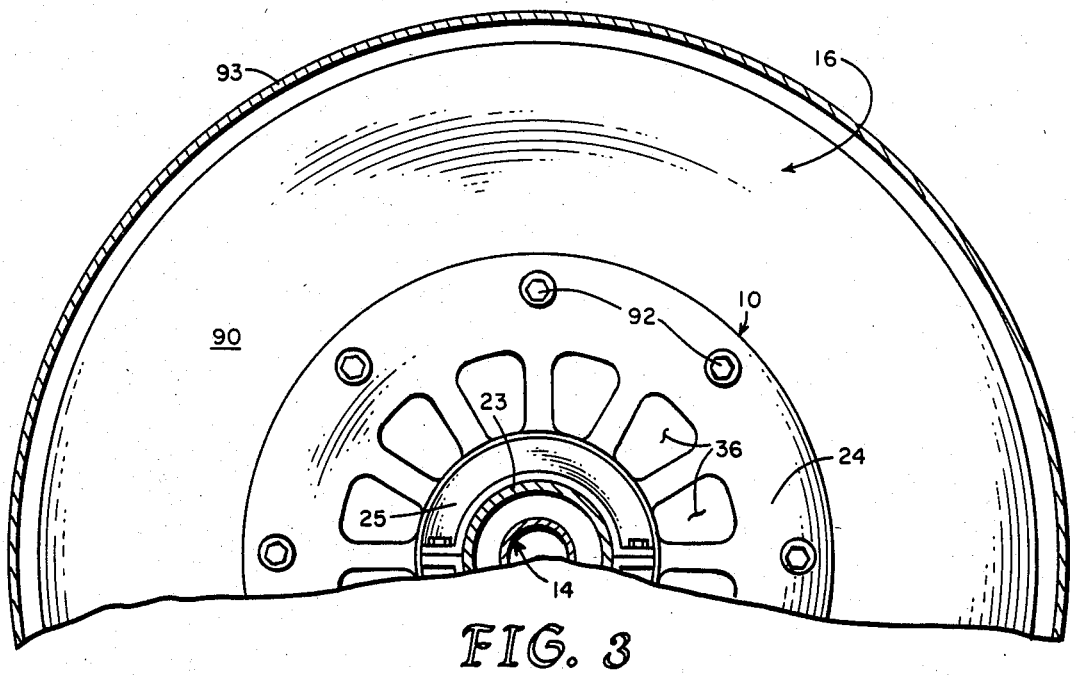
FIG. 3
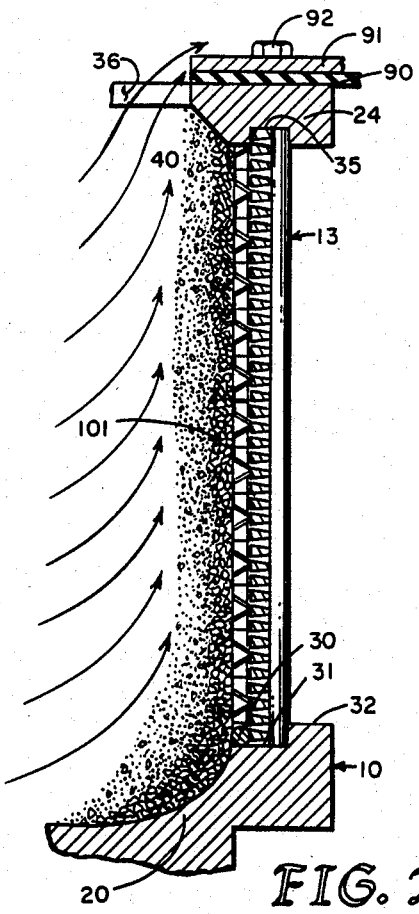
FIG. 7
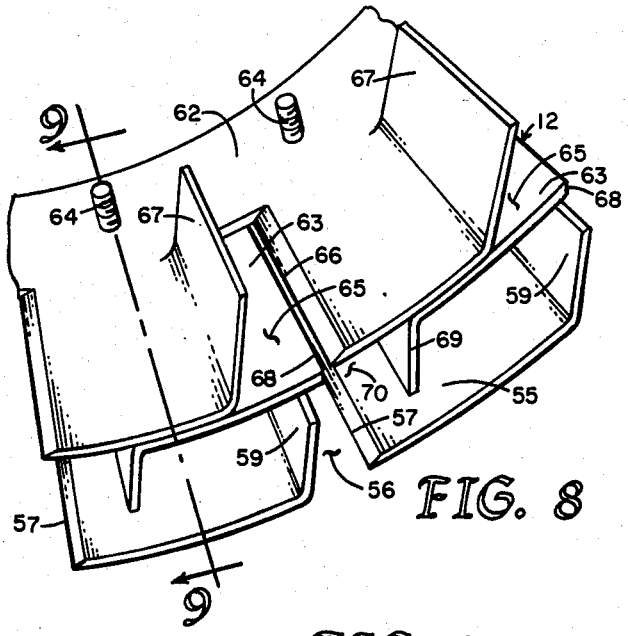
FIG. 8
FIG. 9
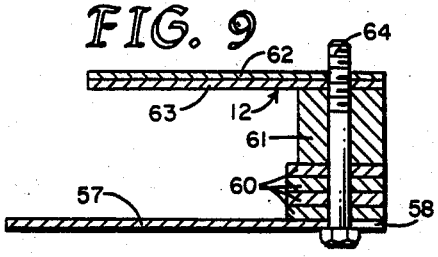

CENTRIFUGAL JIG FOR ORE BENEFICIATION

RELATED APPLICATIONS

There are no applications related hereto heretofore filed in this or any foreign country.

FIELD OF INVENTION

My invention relates generally to an apparatus and provess for beneficiation of particulated ore by a rotary jig and more particularly to such a jig pulsed simultaneously at plural spaced areas with gas bubbles or a combination of gas bubbles and fluid.

DESCRIPTION OF PRIOR ART

Most naturally occurring ores contain such a low proportion of desirable minerals that they generally may not be directly treated by primary extraction processes without some sort of beneficiation. Various means of beneficiating ores have long been known and extensively used. Among these, jigging is one of the more common and most efficient as it makes use of several different physical forces and conditions, most of which can be regulated and several of which may have synergistic operation.

Historically, jigs in their original form provided a screened orifice defined in a frame which supported the material to be operated upon and could be moved vertically in a fluid bath to cause particle segregation. As the process became more sophisticated relative fluid motion was generally established in the fluid bath and the screen remained stationary, usually in a substantially horizontal orientation. Thereafter and in the more recent past, the jigging bed has been transformed into a cylindrical shape and the jigging carried out in a radial direction relative thereto to make use of centrifugal forces substantially greater than the force of gravity. The cylindrical jigs heretofore known have been pulsed by differential pressures produced in the entire surrounding fluidic body which has caused a pulsing of the entire jigging bed at one time, especially as described by Thomas P. Campbell in his U.S. Pat. No. 4,279,741 issued July 21, 1981.

In general, the cylindrical jig allows jigging operations that may not be accomplished with the horizontal jig. Some type of outward radial force must be applied to the bed material to maintain it upon the jigging screen since with normal vertical cylindrical orientation gravity will not accomplish this function as with a horizontal bed. This force may be and has been established by radial fluid flow, but most commonly and conveniently it is established by rotating the jig screen to create centrifugal forces. The screen rotation when combined with the action of gravity, generally perpendicularly to the centrifugal force, has added a second new function to the jigging process. Both of these functions create new and different physical forces which produce quite different results.

The instant invention adds new dimensions to this existing art state by pulsing the jig bed simultaneously at plural spaced points about its periphery during its rotation, by modifying the fluidic bed by incorporating air bubbles to change its overall density, viscosity and physical action on bedded particles and by moving particulate matter from an initial lower position upwardly over a vertical jigging screen. These new functions require some necessarily associated new structures and other novel structures, not necessarily associated with the new functions, have been added to improve the jigging function, namely a wedge-type non-plugging jigging screen and impeller-type devices to aid in sealing the hutch closure in areas between it and the relatively moving rotor.

Rotating bed jigs heretofore known have pulsed the jigging bed by differential fluidic pressures applied simultaneously to the entire jig screen during each pulse. In general this pulsing has been of a simple plunger type and has not involved secondary sucking action. This later action is often used with horizontal jigs, but is carried out only with substantial difficulty and complexity in rotating jigs.

The pulsing of a rotary screen by simple plunger action produces different results than that type of pulsing of a horizontal screen since in the former case the particles in the jig bed are carried on the inner surface of a cylinder and therefore when they move inwardly they move into a lesser space and are necessarily more compacted than if they were to move vertically upwardly relative to a horizontal plane as in a horizontal bed jig. Because of this the jigging action of a cylindrical jig is generally less efficient and admits of less trickling than a horizontal jig. The instant invention resolves this problem by jigging or expanding the jig bed in plural spaced areas simultaneously so that the jigged particles have adequate space to expand into so that they do not interfere with each other, to operate similarly to the jigging operation carried out by a horizontal bed jig. The sequential jigging at plural spaced areas about the jig bed also provides a much more rapid operation of the device than compared to an ordinary cylindrical jig, and in fact one that is substantially faster than the action of a horizontal jig, since the overall jigging action of the bed will be roughly equivalent to the jigging action of a similary sized bed multiplied by the number of jigging fixtures provided about the jig screen. This type of jigging action on a screen also tends to allow physical parameters that are not available with other types of jigs, such as the much more rapid jigging of any particular area of the jig bed so that the bed may not tightly compact between successive jigging operations to lessen efficiency, especially by preventing what is called a consolidation trickling reaction-the passage of fine particles past larger particles, especially ragging, during the last stages of the jigging bed's consolidation. This type of action also tends to prevent bed rupture which tends to be accelerated with ordinary centrifigual jigging.

The fluidic medium normally used in ordinary ore jigging is water, largely because of its availability and low cost. Other types of fluid beds, of either greater or lesser density, have become known but have not become particularly popular because of cost and the relative efficiency of water beds with most minerals. In general, however, as the difference between the density of the particles being processed and that of the fluidic bed increases, the better, more efficient and faster, the separation of the heavier particles may be. I lessen the overall effective density and viscosity of my fluidic medium by introducing therein finely dispersed air bubbles. This is accomplished by plural pulsing heads spacedly positioned about the periphery of the rotating screen. Each pulsing head provides a medial body portion from which pressurized air is dispersed to form fine bubbles. The pulsing medium is passed in a coherent stream toward the jig bed to cause an inward expansion or jigging action therein.

In addition to increasing the effective differential density between particles and medium, a mixture of air bubbles and water amplifies the effect of pulsing on the jig bed, reduces the effective viscosity of the fluidic bed and allows use of a deeper jig bed than heretofore used. The bubbles also encourage an upward motion of material over a vertical jig bed. Rotary jigs heretofore known have either angled the jigging bed upwardly and radially outwardly to move particles thereacross by centrifugal force or, if the bed be vertical, have mored the particulate matter in a downward direction thereacross aided by gravity force. The air bubbles in my jig, aided by a bottom type feed, cause the particulate matter in the jigging bed to move upwardly. The effects of gravity on the particulate matter in the bed are overcome to allow a more efficient and controlled operation in my device than in jigs that feed pulp material in a downward direction. The use of a deeper jig bed also increases efficiency, especially by enhancing the hindered settling classification of the particles and the consolidated trickling effect thereafter as hereinafter described.

In the prior art the screen element that has supported a jig bed has generally been of a woven nature with wire-like elements forming plural, relatively small, spaced orifices. Often such screens have been so fine as to range into the one hundred to two hundred mesh size. These screens have not only substantially limited the porportion of open area available for passage of pulsing fluid but also have tended to limit the passage of ore particles therethrough, especially if the ore particles be of any elongate shape varying substantially from spheroidal. These woven screens also have had a substantial tendency for clogging.

I provide in my apparatus a jig screen formed with a plurality of spaced parallel annular elements of truncated wedge-shaped cross-section having their bases facing inwardly, so that if a particle initially passes into the screen it necessarily will continue its passage therethrough. The annular elements are positionally maintained by plural spaced perpendicular rods on their outer surface which tend to aid the screen in maintaining frictional engagement with the fluid bed thereabout to cause that fluid to rotate somewhat coincidentaly with the screen. This type of screen presents about a thirty percent open area which is quite sufficient for fluid pulsing and provides a longer maintenance free life and more efficient operation than traditional woven screens. This type of screen may be protected on its inner surface by auxiliary structures, but whether protected or not, the screen is of sufficient rigidity and durability to allow use as a pure centrifuge if desired without maintenance of a jigging bed on the inner surface. The wedge screen may also support traditional woven screen on its inner as an auxiliary element surface if this be desirable.

Rotary jigs by their nature must provide parts which move relative to each other but yet provide some sort of a seal to prevent the exit of any substantial quantity of fluid through the relatively movable joints. In addition the seals must of necessity operate in an environment that carries relatively hard particulate material which is reasonably abrasive. These conditions have presented a challenge for the creation and development of sealing structures. The instant invention provides a new and novel solution for such a seal. I provide a rotating impeller structure in the hutch immediately inwardly adjacent a circular joint defined between the relatively moving parts. The rotating impellers create a turbulence adjacent the joint which tends to move fluidic materials away therefrom. This action may be enhanced, especially in lower seals which operate under some fluid pressure, by introducing pressurized air through the space between relatively moving elements and into the hutch chamber.

My invention differs from the prior art and constitutes an improvement over it in each of the individual structural features set forth and in the entire synergistic combination of all of them to be uniquely distinguishable from that prior art.

SUMMARY OF INVENTION

My invention generally provides a rotor, supported and powered from beneath, rotating in a chamber defined by a non-rotating hutch extending about the upper portion of the rotor.

The rotor provides horizontally spaced rotor plates that carry a cylindrical screen member therebetween to define a cylindrical jigging chamber to support a jigging bed. The screen member is formed of plural annular horizontal elements, having a cross-section shaped as a truncated wedge with the bases of the wedges facing radially inwardly, supported in spaced vertical array by plural rods. Immediately inwardly adjacent the jig screen is a secondary screen formed of expanded metal to protect the jig screen and move adjacent hutch material somewhat coincidently therewith during rotation. The upper rotor plate defines a plurality of tailings orifices with outer radial extent coincident with the inner portion of the screen element to allow tailings to pass therethrough for collection and exhaustion.

The rotor shaft defines a medial input chamber extending downwardly to the lower rotor plate where plural communicating slurry channels pass material into the jigging chamber. A secondary non-rotating input pipe, mechanically independent of the rotor, deposits slurry material into the rotor shaft channel.

The hutch is journaled on the rotor shaft and is supported by external structure. Seals are associated with adjacent surfaces of rotor and hutch to prevent exit of substantial quantities of fluid.

Plural pulsing cylinders are positioned in the outer jigging chamber at spaced distances radially outwardly from the screen. These cylinders supply pressurized air to pulse a jigging bed supported on the jigging screen.

The hutch carries a tailings collection system to collect and exhaust tailings exiting through the upper rotor plate. The lower portion of the hutch provides an annular collection area for heavier particulate concentrate and an associated collection system to extract concentrates during the jigging operation.

The rotor is provided with powering means to cause adjustable rotation thereof. The pulsing system is provided with adjustable means of supplying pressurized air and water therethrough and the hutch chamber is provided with means of supplying low pressure water therein to cause a flow therefrom. My invention may be operated as a pure centrifuge, but if it be operated as a rotary jig normally ragging is provided to aid in establishing and maintaining a jigging bed.

In providing such a device it is:

A principal object of my invention to provide a rotary fluidic bed jig that inputs particulate pulp at the bottom of a jigging screen with material moving upwardly over the screen for exhaustion.

A further object of my invention to provide such a rotary jig that is pulsed for jigging action simultaneously at multiple, spaced points about the periphery of the jigging screen.

A further object of my invention to provide such a jig that has a cylindrical jigging screen formed of spaced similar annular elements, each having a wedge-like cross-section with the base of the wedge radially inwardmost, supported by plural spaced vertical rods.

A still further object to my invention to provide such a jig that has annular impellers adjacent the relatively moving surfaces of hutch and rotor to tend to prevent fluidic material in the hutch from exiting between those relatively moving surfaces.

A still further object of my invention to provide such a device that may accept and process dry particulated pulp or most any fluidic mixture thereof.

A still further object of my invention to provide a rotary jig that is more efficient, faster and more durable in beneficiating ore materials carrying heavy metals than the devices of the same type heretofore known.

A still further object of my invention to provide a new process for centrifugal jigging of ore materials for their beneficiation by simultaneously jigging relatively small areas of the bed at spaced distances without jigging the areas of the bed therebetween.

A still further object of my invention to provide such a process that provides a jigging medium comprising a fluid and relatively small entrapped gas bubbles to increase the effective differential density between the fluidic bed and the particulate bed.

A still further object of my invention to provide such a mechanism and process that are of new and novel design, of rugged and durable nature, of simple and economic manufacture and ones that are otherwise well adapted to the uses and purposes for which they are intended.

Further objects of my invention will appear from the following specification and accompanying drawings which form a part hereof. In carrying out the objects of my invention, however, it is to be understood that its essential features are susceptible of change in design and structural arrangement with only one preferred and practical embodiment being illustrated in the accompanying drawings and specified as is required.

BRIEF DESCRIPTION OF DRAWINGS

In the accompanying drawings which form a part hereof and wherein like numbers of reference refer to similar parts throughout:

FIG. 2 is a horizontal cross-sectional view through the rotor and hutch illustrated in FIG. 1, taken as on the line 2—2 thereon in the direction indicated by the arrows.

FIG. 3 is a partial plan view taken on the line 3—3 of FIG. 1, in the direction indicated by the arrows thereon.

FIG. 4 is a somewhat enlarged isometric view of one of the pulsing devices of my invention.

FIG. 5 is a vertical cross-sectional view of the pulsing device of FIG. 4, taken on the line 5—5 thereon, in the direction indicated by the arrows.

FIG. 6 is a partial, cut-away, somewhat diagrammatic view of a small portion of the jig screen showing its various elements, their details, and their relationship.

FIG. 7 is a somewhat diagrammatic cross-sectional view through a typical jigging bed in its normal collapsed mode.

FIG. 8 is an isometric view of a segment of the lower impeller of my invention showing its elements, their relationship and configuration.

FIG. 9 is a vertical cross-sectional view through the impeller of FIG. 8, taken on the line 9—9 thereon, in the direction indicated by the arrows.

DESCRIPTION OF PREFERRED EMBODIMENT

Figure 1:
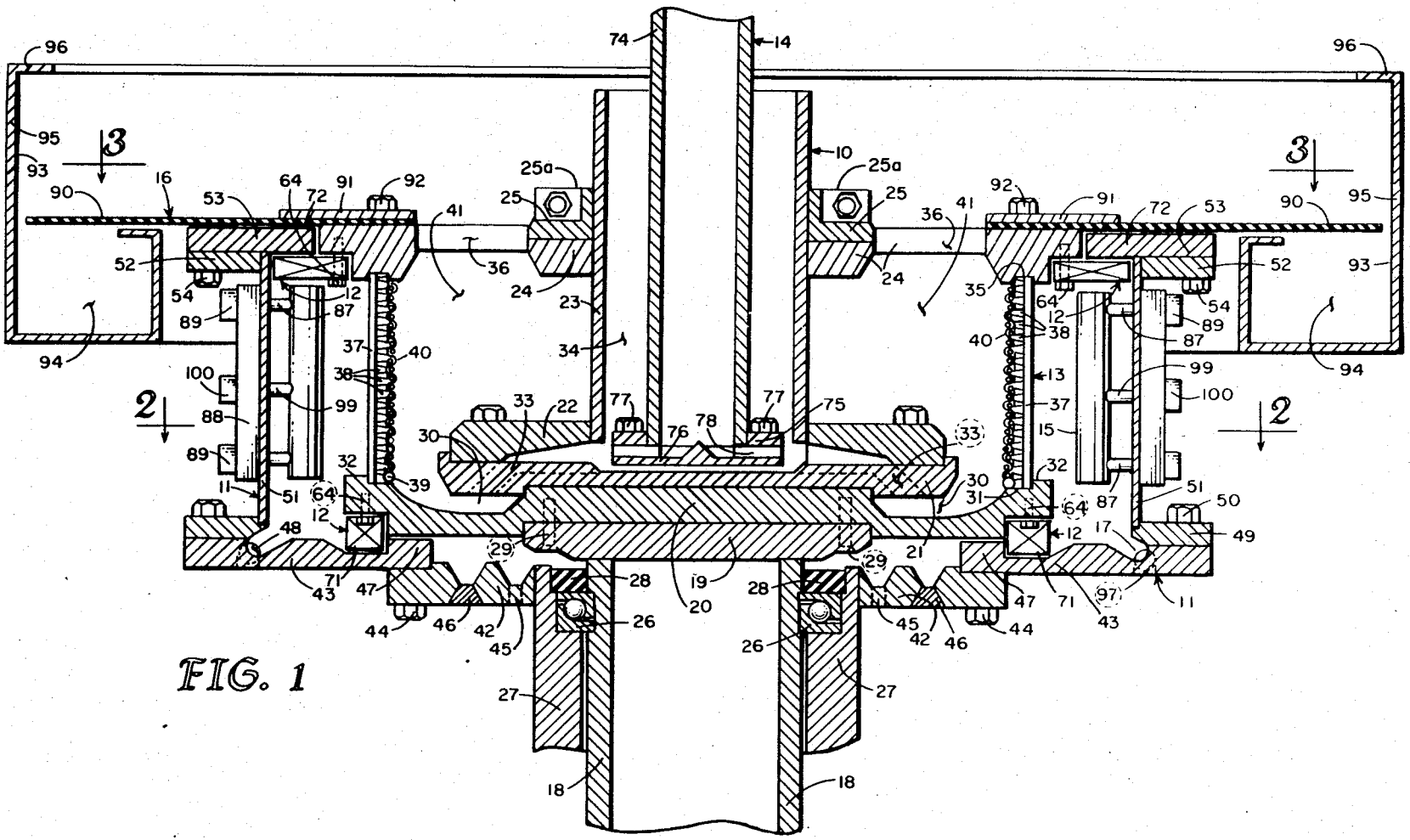
FIG. 1 is a vertical cross-sectional view on a diameter through the rotor and hutch of my invention showing its various parts, their configuration and relationship.

My invention generally provides rotor 10 carried in cylindrical hutch 11 with impellers 12 associated with joints between relatively movable parts of these elements. The rotor defines input mechanism 14 that delivers ore pulp to a jigging bed supported by cylindrical jigging screen 13 thereabout. The hutch provides pulsing system 15, to pulse the jigging screen at spaced locations about its circumference, and provides ancillary tailings collections mechanism 16 and concentrate collection system 17.

Rotor 10, as seen in the cross-sectional view of FIG. 1, provides lower shaft 18 structurally supporting shaft cap 19 which irrotatably carries lower rotor plate 20. The lower rotor plate in turn irrotatably communicates with radially smaller lower ore input plate 21 thereabove which releasably and irrotatably supports upper ore input plate 22 that carries upwardly extending input pipe 23 extending a distance thereabove. The upper input pipe, at spaced distance about the lower rotor plate, carries upper rotor plate 24 which interconnects therewith by upper plate connecting annulus 25 which fastens the structure to the input pipe.

The lower portion of rotor shaft 18 is journaled in bearing 26 carried by jig pedestal 27 which is in turn supported by jig framework that is not illustrated. The rotor shaft in its medial lower part is powered for rotation (not shown), preferably at an adjustably predetermined rate, by means not shown. Annular seal 28 is provided above bearing 26 to form a reasonably water tight seal between the jig pedestal and lower shaft but yet will allow free rotation of these parts relative each other. Shaft cap 19 is mechanically joined to the uppermost portion of the lower rotor, shaft preferably by welding, and joins lower rotor plate 20 by means of bolts 29 threadedly communicating therebetween.

Lower rotor plate 20 defines medial input annulus 30 having outwardly and upwardly extending bottom portion communicating with jig screen ledge 31 which in turn communicates with jig screen lip 32 extending upwardly thereabove sufficiently to present a buttress for positional maintenance of the lower portion of the jig screen. The upper and lower input plates cooperate to define therbetween plural spaced radially extending input orifices 33 extending from chamber 34 defined by input pipe 23 radially outwardly and downwardly to exit into the inner portion of input annulus 30 of the lower rotor plate.

Upper rotor plate 24 is maintained at a spaced distance above the lower rotor plate by support on input pipe 23 which extends somewhat thereabove. The upper rotor plate is positionally maintained by connecting annulus 25 which is formed with slots between cooperating ears **25*a* that may be tightened relative to each other to releasably maintain the structure in appropriate position on input pipe 23. The upper rotor plate inwardly adjacent its periphery defines upper jig screen groove 35 in a position vertically above jig screen ledge 31 defined in the lower rotor plate. This upper jig screen groove is appropriately shaped to accept and positionally maintain the upper portion of the jig screen structure. An annular portion of the upper rotor plate radially inwardly of the jig screen groove defines a plurality of spaced elongate gangue orifices 36** to allow the upward passage of processed gangue material or tailings therethrough for exhaustion. The size, configuration and positioning of the gangue orifices are not particularly critical but in general they should provide a substantial open area of better than fifty percent of the area of the annulus wherein they are defined to allow appropriate tailings exhaustion.

Jig screen 13 is a cylindrical structure providing radially outer spaced vertical support rods 37 structurally communicating with each of a plurality of vertically spaced annular horizontal screen elements 38. Each of the screen elements has a cross-section shaped as a truncated wedge, as illustrated particularly in the enlarged cross-section of FIG. 7, and each of the elements has its lesser vertical dimension (truncated apex) radially outwardmost so that the annular slots defined between screen elements have their smallest vertical dimension on the radially inner surface defined by the screen element. This type of screen provides a non-clogging structure, since if a particle can pass through the radially inner portion of a slot it must of necessity be able to pass through any other portion of the slot which is larger. This type of screen per se is not new and has heretofore become known in the classification of particulate matter based upon peripheral configuration and dimension. The radial inner, lower edge of the jig screen is provided with annular gasket 39 which tends to prevent particulate matter from exiting radially outwardly from beneath the screen and between it and its joinder with the jig screen ledge of the lower rotor plate.

A secondary cylindrical inner screen 40 is provided immediately radially inwardly adjacent the inner surface of the wedge screen. This secondary inner screen is preferably formed of expanded metal, as illustrated particularly in the enlarged surface view shown in FIG. 6. The purpose of this secondary screen is to protect the wedge screen and to provide a more substantial frictional engagement with hutch fluid about the element to cause that fluid to rotate in substantial coincidence therewith. Normally but not necessarily the secondary screen is not maintained within the screen groove defined by either the upper or lower rotor plates for ease of manufacture and assemblage and use as it is positionally maintained by reason of its fit against the inner surface of the primary wedge screen.

The rotor structure and screen element combine to define enclosed cylindrical jigging chamber 41 wherein the jigging operations are carried out. All of the various elements of the rotor and jigging screen, except the gaskets, are formed of metal for appropriate strength and rigidity. The gasket may be metal but normally is of some traditional gasket material such as a resiliently deformable plastic or elastomeric material.

Hutch 11 extends about jigging chamber 41 to define a chamber for containment of a fluidic medium. The hutch structure provides a compound bottom plate formed by lower inner annular bottom element 42 releasably supporting upper outer annular bottom element 43. The two elements are releasably interconnected in water tight joinder by plural bolts 44 threadedly communicating therebetween. Lower inner annular bottom element 42 provides passageways 45 for input of compressed air, if desired, and provides at least one plugged drain orifice 46. The radially inner portion of upper outer bottom element 43 provides an upwardly extending sealing annulus 47 that extends upwardly into immediate adjacency with the lower surface of lower rotor plate 20 to form somewhat of a seal therebetween, but yet allow free rotation of the elements relative to each other. The upper outer annular element, at a spaced distance radially inwardly from its periphery, defines annular concentrate groove 48 wherein concentrate extracted through the screen element settle and may be collected.

The radially outer peripheral portion of hutch bottom element 43 carries cylindrical lower side support ring 49 releasably positionally maintained thereon by plural bolts 50 extending in threaded communication between the elements. The side fastening ring structurally supports vertical cylindrical hutch side 51 which in its upper part structurally carries upper annular upper support ring 52 extending radially outwardly thereabout. This upper annular side support ring structurally carries annular hutch top 53 at the same level as, and extending radially inwardly to immediate adjacency with, the radially outward surface of upper rotor plate 24 to provide somewhat of a fluid seal between these elements. This annular hutch top is releasably positionally maintained on the top of upper side fastening support by bolts 54 threadedly engaged herebetween. The hutch top as so formed should provide an uppermost surface at or below the uppermost surface of upper rotor plate 24 and the rotor structure must freely rotate relative to the hutch.

Impellers 12 aid in preventing fluid media in the hutch chamber from passing between adjacent surfaces of rotor and hutch. As shown especially in the partial isometric view of FIG. 8, the impellers are compound annular elements of a vane nature that upon rotation tend to move fluid away from joint area between rotor and hutch. The upper and lower impellers are each substantially the same except that one would be a mirror image of the other. The lower rotor element is that illustrated in FIGS. 8 and 9.

Lower impeller vein element 55 comprises an annular disk having slots 56 defined therein by cutting a radial edge 57 and inner circular edge 58. The radial edges 57 are most distal from the direction of rotation of the device. The material within slot 56 is then upturned to form upstanding vein 59 and radial edge 57 is sharpened on its upper forward side to form a knife-like edge, all to aid in creating turbulence in fluidic material surrounding the structure upon its rotation.

A plurality of annular spacers 60 and cylindrical spacers 61 are positioned on the upper surface of lower element 55 to mechanically interconnect upper inner element 62 and upper outer element 63 at a spaced distance therefrom. This positional spacing is maintained by plural bolts 64 fastenably extending through the lower element, spacing elements and upper element as illustrated in FIG. 9. Upper outer element 62 is formed in fashion similar to the lower annular element with slots 65, radial edges 66, and upturned vanes 67. Inner upper element 63 defines slot 68 similar to those of the other two vane elements, but in this instance with square slot edges and fins 69 downturned. The slots in the upper inner element are so configured, as illustrated in FIG. 8, that radial edges 68 are immediately forward (in the direction of rotation) of sharpened edges 66 of the outer element and the downturned fins 69 are spaced about evenly between adjacently upturned fins of lower annular element 55, as illustrated.

The lower impeller is releasably positioned on the lower peripheral surface of lower rotor plate 20 by bolts 64 threadedly engaged therebetween. This impeller is so configured that its inner peripheral surface is immediately outwardly adjacent the joint between the lower rotor plate and the lower portion of the hutch. The upper impeller is similarly designed, as a mirror image of the lower impeller, and attached to under side of top plate 24 in annular impeller groove 72 in the peripheral area of the upper rotor plate, as illustrated in FIG. 1, so that it is immediately below the joint between upper rotor plate and hutch. This upper impeller is positionally maintained in a realeasable fashion by bolts 64 threadedly engaged between the impeller and the upper rotor plate. Each of these impellers then will rotate with the rotor and in so doing will tend to move water away from the adajacent joint between the rotor and the hutch to lessen fluidic pressure in this area and tend to prevent the fluid medium and any particulate matter therein from entering and exiting through the area between adjacent surfaces of the two elements.

Input systems 14 provide for the input of ore pulp into the jigging bed defined by the rotor and of water into the hutch. Water is input through tangentially positioned input pipe 73 carried in a medial position on cylindrical side 51 of the hutch, as shown especially in FIG. 2. The water input system provides a continuous supply of water under low pressure, of some one to five pounds per square inch, to establish and induce the flow of fluids through and from my mechanism. The water input system provides valving means (not shown) for both regulating and stopping the flow of water. This is accomplished by well known methods and the details of such system are therefore not described in any detail.

Ore pulp is input into the rotor mechanism through the medial channel defined in input pipe 23. This is accomplished by means of vertically oriented pulp feed pipe 74, of external diameter somewhat less than the internal diameter of input pipe 23, extending downwardly through the open top portion of that input pipe to a position immediately above its bottom. The pulp input pipe structurally carries in its lower part annular fastening flange 75 extending radially outwardly therefrom to interconnect and support input pipe bottom plate 76 immediately therebelow by plural bolts 77 threadedly engaged therebetween. The bottom input plate defines plural spaced radially extending input channels 78 defining passageways from the interior of the pulp input pipe through the bottom input plate and to the channel defined by rotor input pipe 23. Appropriate pulp supply structure, that is not shown, allows and regulates input of ore pulp to the input pipe. Again this pulp supply structure is well known in the ore beneficiation arts and therefore not illustrated or described in detail. The pulp input pipe is supported by an external frame (not shown) and does not rotate relative the rotor structure or hutch.

Pulsing system 15 provides plural spaced pulsing stations in the hutch chamber to pulse the rotating screen bed with gas. Each pulsing station provides a pulsing cylinder 79 as shown in detail in FIGS. 4 and 5. The pulsing cylinder may be formed of porous material such as porous ceramic, pressed metal powders or machined metal parts which provide a plurality of orifices. The cylinder is configured in the elongate shape illustrated with alternating annular thread-like ridges 80 and grooves 81 each appropriately dimensioned to allow dispersal of gas therefrom.

Each cylinder is provided with a peripheral shield 82 configured to fit about the external surface of the pulsing cylinder and define a slot 83 through which pressurized media presented through the cylinder may be passed in a reasonably coherent pattern toward the rotating screen. This shield may be appropriately positioned and configured to regulate the impact area of pulsing medium upon the screen and may be variously dimensioned to regulate the concentration of a pulsing stream, all to provide substantial control over the pulsing.

The pulsing cylinders illustrated show both porous and groove-type dispersing means, though either may be used independently. Each pulsing cylinder defines upper internal channel 84 and lower internal channel 85 each extending inwardly from the ends of the cylinder which are sealed by plugs 86 supported by the end parts of peripheral shield 82. Normally one chamber will be somewhat longer than the other and the two do not interconnect so that by using one or the other chamber, of pressurized gas may be dispersed over various areas as desired. Each pulsing cylinder channel communicates by rigid connector pipes 87 radially outwardly through the wall of the hutch and to fastening structure 88 which interconnects with connector fixtures 89 carried thereby. The connector pipes are of appropriate strength and rigidity to mechanically support the pulsing cylinders and their associated structures on the hutch. Connector fixtures 89 provide means for interconnection with external sources of pressurized gas. The supply system of pressurized gas provides appropriate control mechanism to regulate the supply of gas, again by means not shown and well known.

A half cylindrical supply plenum 98 is defined in the periphery of the pulsing cylinder, extending between its ends, to supply pressurized media into the grooves or channels 81. The supply plenum is enclosed on its outer surface by shield 82 and at its ends by plugs 86. Supply pipe 99 communicates from supply plenum 98 radially outwardly through the hutch to terminate in connector 100 which provides a fixture for interconnection with a source of pressurized media. Again, the pressurized media supply has control means of known type to regulate the flow to the pulsing cylinder.

Normally several such pulsing cylinders will be spaced within and about a particular hutch, as in the case illustrated where four such devices are shown. Normally, but not necessarily, the spacing of these pulsing cylinders will be circularly symmetrical, the vertical height of each pulsing cylinder will be substantially the same as that of the rotating screen, and their vertical position approximately the same as the screen. Though a porous metal is preferred, the pulsing cylinders obviously may be formed of other porous materials that are reasonably rigid and durable, especially such as ceramics or plastics.

Tailings collection system 16 provides means for the continuous collection of tailings or gangue material. The collection system provides flat annular tailings disc 90 having an internal diameter substantially coincident with the external diameter of gangue orifices 36 defined in upper rotor plate 24 and an external diameter greater than that of the hutch structure. This tailings disc is preferably formed of some semi-rigid, reasonably thin material such as neoprene or a similar elastomer and is fastened to the upper peripheral surface of the upper rotor plate by fastening annulus 91 which is positionally maintained by plural spaced bolts 92 extending therethrough and into threaded engagement with the outer rim of the upper rotor plate therebeneath. Annular tailings collection housing 93 extends about the periphery of tailings disc 90 to collect the tailings passing thereover. This peripherally defined structure provides annular tailings collection channel 94 with radially outwardmost vertical wall 95 extending for some distance above tailings disc 90 and having radially in-turned upper edge 96 to aid in the tailings collection. As the tailings pass from and over tailings disc 90, they will ultimately be collected in tailings channel 94 by reason of centrifugal force and gravity and they may be passed therefrom by a collection system (not shown) for exhaustion.

Concentrate collection system 17 provides plural tangential discharge ducts 97 defined in outer annular element 43 of the hutch bottom structure to communicate from concentrate groove 48, defined by that structure, therethrough to allow continuous passage of concentrates from the hutch during operation. The cross-sectional area of concentrate ducts 97 will be relatively small so that no substantial amount of fluidic medium will be passed through the ducts to be exhausted therefrom. The ducts normally are provided with valving means (not shown) to regulate flow therethrough and are serviced by other collection apparatus well know in the ore benefication art for containment of concentrates and separation thereof from fluidic medium associated therewith.

Having thusly described my invention, its operation may now be understood in light of the foregoing specification.

For a normal jigging operation most generally it is desirable or necessary to establish a bed of so called 'ragging' 101 on the inner surface of the jigging screen. This ragging, as shown in the partial cross-sectional view of FIG. 7, comprises inert particulate material, commonly of differing particulate size and often differing density than pulp material to firstly provide support for a jigging bed and secondly provides a bed of some thickness wherein the complete jigging operation may be effectively carried out. The nature of ragging in general and its various uses and functions are known in the jigging arts and ragging in my invention generally fulfills the same purposes, functions and uses as those heretofore known. The ragging bed may be established on the jigging screen by introducing the appropriately selected material through pulp input pipe 74 and operating the machine to rotate the rotor. The ragging will pass to the inner surface of the jigging screen and there tend to classify itself into an appropriate jigging bed support. Normally the pulp feed material to be beneficiated by my invention will not have appropriate particle size to create an effective jigging bed by itself and it usually is desirable to pre-establish a jigging bed of appropriately sized particulate matter before introduction of the pulp material to be operated upon.

To use my invention the mechanism is created according to the foregoing specification, ragging established and the various systems serviced with material that they disperse and powered as required. Pulp material that is to be beneficiated is formed according to principles well known in the art, to a particulate size and gradation desired for the particular operation. The pulp material is then introduced in my jig normally in the form of a slurry of admixed particles and water. The hutch is then filled to overflow with fluidic medium, normally water, and the rotor is activated to rotate on its axis.

In this condition the pulp material to be beneficiated is introduced into pulp input pipe 74 from whence it passes downwardly therethrough by operation of gravity, though if desired the pulp material may be introduced under low pressure of a few pounds per square inch to further aid its motion. The pulp material when it arrives at the bottom of the pulp input pipe will pass radially outwardly, by reason of gravity force, through channels 78 in bottom input plate 76 and into the channel defined by input pipe 23 of the rotor structure.

As the pulp material is dispersed into the channel defined by input pipe 23, the material will be rotating to some degree by reason of the frictional contact of the material with the surface of the rotating input pipe. As this occurs centrifugal force will be created in the fluidic pulp material in the channel and it will tend to move radially outwardly to enter the inner orifices of input channels 33 defined between the upper and lower input plates. As the material enters these channels it will be moved radially outwardly therethrough by reason of increased centrifugal force to enter the jigging chamber defined by the rotor in the lower portion of that chamber.

As the pulp material enters the jigging chamber there will be substantial centrifugal forces on the material and by reason thereof it will tend to move radially outwardly. As it does so these centrifugal forces will increase as a function of the distance from the rotary axis. By reason of the upward curvilinear shape of the upper outer surface of lower rotor plate 20, the pulp material and especially the particulate matter therein will be directed not only radially outwardly but also upwardly toward the bottom of jigging screen 13. The particulate material will ultimately come to rest in, and form a bed upon, the ragging inwardly adjacent screen element 13. As the process continues and more pulp material enters the jigging chamber, it too will tend to move upwardly and to displace in an upward direction other particulate material on the inner surface of the jigging bed until ultimately the material moving upwardly across the screen exits from the jigging chamber through gangue orifices 36 in the upper rotor plate.

Pulsing of the screen bed will be accomplished in my invention by a stream of pressurized gas, commonly air continuously passing from the pulsing heads. This gas is introduced either under fairly high pressure into channels 84, 85 in pulsing cylinders 79 from whence it passes through the porosity therein to the external surface thereof or else into plenum 98 and through grooves 81 from which it is disbursed in the form of relatively small bubbles in the fluidic medium in the hutch. The bubbles will be dispersed in a somewhat coherent stream and directed in a particular spatial pattern by shield 82 carried about a pulsing cylinder. In general this bubble stream is directed substantially radially inwardly toward an adjacent area of the jigging screen. These bubbles will tend to move inwardly because of the greater mass of and centrifugal forces upon the water in which they exist. The water in the hutch on both inner and outer surfaces of screen element 13 will have some frictional engagement with the screen element and will tend to move somewhat coincidentally with that element. This rotation of the fluidic bed will decrease as a function of distance from the screen element. These rotary forces created in the hutch fluid will tend to act in a resultant fashion to cause the lighter air bubbles to move inwardly in a curvilinear course angled in the direction of rotation of the rotor.

As the stream of bubbles impinges upon the outer surface of rotary screen element 13, the bubbles will tend to coalesce to some degree and to move through the screen element and into the jigging chamber defined by the rotor by reason of the same forces that caused bubble motion in the hutch outside the rotor. As this occurs the jigging bed on the inner surface of screen element 13 will be moved radially inwardly and disturbed in a fashion somewhat similar to the normal vertical jigging action of a horizontal jig screen. As the screen element rotates past a particular pulsing cylinder, the jig bed will tend to collapse, or more properly settle upon the inner surface of the screen element by reason of centrifugal force, in substantially the same fashion of an ordinary horizontal jigging bed, with similar classifying and trickle effects. As this occurs the smaller, more dense particulate matter, which normally includes the metal fraction, will tend to move radially outwardly through the jigging bed to ultimately pass through the screen element and into the hutch area surrounding it by reason of the proportionately greater centrifugal forces upon it. In the hutch area outside the jigging screen, the particulate matter will move radially outwardly and downwardly by action of gravity to ultimately come to rest in concentrate groove 48 from whence it may be removed.

At the same time the gangue material, which normally tends to be less dense, will remain on the inner surface of the screen and will tend to move vertically upwardly both because of the input of more pulp material therebelow and the action of the jigging bubbles introduced by the pulsing cylinders. In this regard it should be remembered that not only will those bubbles be acted upon by reactant or "negative" centrifugal force but also by a similar negative type gravity reaction because they exist in a more dense fluidic medium. In other words, because of their lower density, the bubbles will tend to be forced upwardly and inwardly and the water downwardly and outwardly. This action tends to move gangue material upwardly across the jigging bed until it ultimately exits through the gangue orifices defined in the top plate of the rotor structure.

In this type of rotary jigging operation described, the forces upon the particulate matter at the inner surface of screen element 13 will be substantially greater than ordinary gravity forces on the common horizontal jigging screen. In fact, generally, they may be greater by a factor of approximately forty. Again, since the jigging medium commonly used is gas, the overall effective density of the fluidic bed will be somewhat less than the density of water, again oftentimes differing therefrom by a factor of two or more. Because of this substantial increase in gravity force and decrease in density of the fluidic bed, a different type of jigging action is accomplished than with known centrifugal jigs to tend to segregate the heavier particulate matter more rapidly and more efficiently than is done with traditional processes. My process also allows the separation of the finely particulate matter, such as flour gold, whereas in general the traditional jigs heretofore known have not provided an efficient beneficiation of such material. My invention also seems to allow the separation of the heavier mineral particles from a pulp that varies in particle size and shape over a broader range than is normally allowed by the traditional jigging operation.

The various parameters involved with my centrifugal jig must all be appropriately determined by either trial and error or theoretical methods heretofore known in the jigging arts to operate effectively in any particular situation. Normally the pulp feed material for my jig must be particulated to a size in the one hundred mesh range and obviously must be smaller than the slots in the jigging screen. The speed of rotation of the rotor of my jig will, for a screen of approximately fifteen inches in diameter, be in the range of five hundred revolutions per minute to create appropriate forces on the jigging bed to allow it to effectively accomplish its purposes. Normally four equally spaced pulsing cylinders will be used with a fifteen inch diameter cylindrical jigging screen to allow the bed, at the rotational speeds indicated, to collapse before again being expanded by the next cylinder. In general, however, with my invention there is no need to allow the bed to completely collapse as is commonly done with traditional flat screen, horizontal jigging because if the bed in my invention remains somewhat expanded it seems to operate more efficiently, rapidly and effectively. The fluid input to the hutch normally will be such as to maintain the hutch completely full of fluid, but will not be much more to avoid too rapid a motion of particles over the jigging bed and the wastage of too much fluid therefrom.

The tailings pulp that passes through gangue orifices 36 defined in the upper rotor plate will pass onto the upper surface of tailings disc 90 and be propelled radially outwardly thereacross by action of centrifugal force until it exits from the periphery of the disk to be collected in channel 94 of annular tailings collector 93 for subsequent disposition. Surplus fluidic media will also follow this course for exhaustation. If the conservation of water be a problem, wasted water may be collected, separated from the tailings and reused in the jig.

Having thusly described my invention, what I desire to protect by Letters Patent and what I claim is:

1. A centrifugal jig for separating a more dense fraction from a less dense fraction of particulate pulp material comprising:

a hutch peripherally defining a chamber;

a vertical rotor journaled for rotation in the hutch and having an upper rotor plate and a lower rotor plate, said hutch and said lower plate constructed and arranged for substantial containment of fluidic media therein;

means for rotating the rotor;

a cylindrical jig screen defining the periphery of a jigging chamber carried within the hutch by the rotor for coaxial rotation therewith;

input means for directing particulate pulp material into the jigging chamber and onto the lower inner surface of the cylindrical jig screen;

plural pulsing means spacedly positioned about the periphery of the jig screen, each pulsing means directing a continuous stream of pressurized air to and through the jigging screen at spaced positions to pulse the material on the jig screen at each such spaced position as the jig screen rotates past each position so that the jigged particles have adaquate space to expand into so that they do not substantially interfere with each other;

tailings collection means to receive the less dense fraction of the particulate pulp material from the top of the jig screen for exhaustion; and concentrate collection means in the lower portion of the hutch to receive for collection the more dense fraction of particulate pulp material that passes through the jig screen and into the hutch.

2. The invention of claim 1 further characterized by a jig screen formed by a plurality of spaced vertical screen supports interconnecting a plurality of horizontal screen elements on their radially outer surface, each of said horizontal screen elements having a cross-section configured as a truncated wedge with the base of the wedge radially innermost.

3. The invention of claim 1 further characterized by a jig screen having a cylindrical guard screen immediately radially inwardly from its inner surface, said guard screen having means to create frictional engagement with a fluidic medium thereabout.

4. The invention of claim 1 further characterized by the means of collecting tailings comprising a plurality of spaced gangue orifices in the upper rotor plate with a tailings disc extending radially outwardly therefrom and an annular tailings collector extending thereabout, radially outwardly from the hutch, to receive tailings from the tailings disc for disposition.

5. A rotary jig for ore beneficiation that separates a more dense portion from a less dense portion of particulated pulp material, comprising in combination:

a hutch defining a chamber;

a vertically journaled rotor having vertically spaced upper and lower rotor plates carrying a cylindrical jig screen therebetween to define a jigging chamber, said hutch and said lower rotor plate constructed and arranged for substantial containment of fluidic media therein for rotation in the hutch chamber;

plural pulsing heads in the hutch chamber radially outwardly of the jig screen and spacedly positioned about the periphery of the jig screen, each pulsing head having means of directing a coherent stream of pressurized air radially inwardly to spaced areas of the jig screen;

means of feeding particulate pulp material into the lower portion of the jigging chamber;

means of removing a less dense particulate fraction from the upper portion of the jig screen;

means of collecting and removing the more dense particulate fraction from the lower portion of the hutch radially outwardly of the jigging chamber and;

means of rotating the rotor, means of supplying fluidic media to the hutch; and, means of supplying pressurized gaseous media to the pulsing heads.

6. The invention of claim 5 further characterized by:

the jig screen formed by plural vertical radially spaced rods interconnecting plural spaced horizontal annular elements, each said horizontal annular element having a wedge-shaped cross section with the larger vertical side being radially inwardmost and said spaced rods being on the radially outermost surface.

7. The method for separating a more dense fraction from a less dense fraction of particulate pulp material, comprising the steps of:

introducing a slurry of pulp material into a jigging chamber, having a cylindrical peripheral jig screen defining a jig bed on its inner surface and surrounded by a fluidic media;

rotating the peripheral jig screen about its axis at a velocity sufficient to cause centrifugal loading on the jig bed substantially in excess of the force of gravity and to cause rotation in the fluidic media and particulate matter therein to move that particulate matter radially outwardly to the jigging bed supported on the jig screen;

simultaneously jigging the pulp material in the rotating cylindrical jig bed by directing pressurized gas radially inwardly therethrough at plural peripherally spaced positions thereabout to cause the jig bed at said spaced positions to expand inwardly and thereafter at least partially collapse outwardly as it moves past the areas of pressurized gas impingement;

collecting a heavier fraction of particulate matter radially outwardly of the jigging screen; and removing a lighter fraction of particulate matter from the upper portion of the jigging screen.

8. The method of claim 7 wherein the fluidic media within which jigging occurs is water and the pressurized gas that causes jigging of the jig bed is air.

9. The method of claim 7 wherein the pulp material is introduced radially inwardly of the base of the jig screen immediately above a curvilinear surface that extends upwardly and radially outwardly toward the base of the jigging screen so that the pulp material tends to move radially outwardly and upwardly across the jig screen to aid exhaustion from a position thereabove.

10. The method of claim 7 further characterized by:

the jig screen comprising a non-plugging wedge screen having circumferentially spaced vertical rods interconnecting a plurality of horizontally spaced screen elements each having the cross-sectional shape of a truncated wedge with the base of said wedge facing radially inwardly, and ragging carried on the inner surface of said cylindrical screen to aid in maintaining a jig bed.

* * * * *